United States Patent [19]

Yui et al.

[11] Patent Number: 5,003,350

[45] Date of Patent: Mar. 26, 1991

[54] IMAGE FORMING APPARATUS

[75] Inventors: Yuhi Yui; Yukinori Andou; Kouichi Irihara, all of Nara, Japan

[73] Assignee: Sharp Kabushiki Kaisha, Osaka, Japan

[21] Appl. No.: 413,171

[22] Filed: Sep. 27, 1989

[30] Foreign Application Priority Data

Sep. 28, 1988 [JP] Japan ..... 63-245464
Nov. 4, 1988 [JP] Japan ..... 63-279143

[51] Int. Cl.[5] ..... G03G 15/02

[52] U.S. Cl. ..... 355/225; 355/208; 355/219; 355/276

[58] Field of Search ..... 355/225, 219, 221, 224, 355/296, 203, 204, 208

[56] References Cited

U.S. PATENT DOCUMENTS

| | | | |
|---|---|---|---|
| 4,105,324 | 8/1978 | Seil | 355/208 |
| 4,402,591 | 9/1983 | Nakahata | 355/225 |
| 4,500,195 | 2/1985 | Hosono | 355/219 X |
| 4,695,723 | 9/1987 | Minor | 355/225 X |
| 4,831,415 | 5/1989 | Kasuya | 355/208 |
| 4,839,670 | 6/1989 | Snelling | 355/211 X |
| 4,862,209 | 8/1989 | Sakamoto et al. | 355/211 |

FOREIGN PATENT DOCUMENTS

| | | | |
|---|---|---|---|
| 0299502 | 1/1989 | European Pat. Off. | 355/224 |
| 0147376 | 8/1984 | Japan | 355/219 |
| 0073554 | 4/1985 | Japan | 355/219 |
| 0073984 | 4/1986 | Japan | 355/296 |
| 0114281 | 5/1986 | Japan | 355/296 |
| 0294272 | 12/1987 | Japan | 355/204 |

OTHER PUBLICATIONS

IBM Technical Disclosure Bulletin, vol. 15, No. 1, Jun. 1972, p. 91, Branham, C. E., Hunter, M. A., "Negative Corona Control".

*Primary Examiner*—A. T. Grimley
*Assistant Examiner*—Matthew S. Smith
*Attorney, Agent, or Firm*—Flehr, Hohbach, Test, Albritton & Herbert

[57] ABSTRACT

An image forming apparatus has a charger; developing device; transferring device; and cleaning device which are positioned around a photoreceptor, the cleaning device and charger being integrally formed. The charger has a control unit for controlling the surface potential of the photoreceptor to be at a predetermined level in accordance with the number of rotations, or the rotating time of the photoreceptor, and/or is designed such that a predetermined voltage is applied to the cleaning device. With the above arrangement, reproduced images having constant quality can be provided for long even if the photoreceptor is repeatedly used and discharging by the charger toward the photoreceptor can be stabilized. The advantages contribute to producing small-sized and low-priced image forming apparatus.

13 Claims, 7 Drawing Sheets

IMAGE FORMING APPARATUS

FIELD OF THE INVENTION

The present invention relates to an image forming apparatus wherein electrophotography is utilized, such as electrophotographic copying machines, electrophotographic laser printers and the like.

BACKGROUND OF THE INVENTION

In recent years, image forming apparatus wherein electrophotography is adapted, such as electrophotographic copying machines, electrophotographic laser printers and the like have become common in our society. In one well known form of electrophotographic copying machine, as shown in FIG. 9, a photoreceptor 24 disposed rotatably in the direction of the arrow A is first uniformly charged by a charger 25 and exposed to a reflected light 26 from the surface of an original, thereby forming an electrostatic latent image. The electrostatic latent image is formed into a visible image by applying toner stored in a developing device 27. This visible toner image is transferred onto a copy sheet 28 by a transferring device 29, to be fixed by a fixing device (not shown), and then the copying sheet 28 having the toner image thereon is discharged from the body of a copying machine. There remains on the surface of the photoreceptor 24, about twenty percent of toner used for toner image formation. The residual toner is scraped off and removed by a blade 30*a* of a cleaning device 30. Thereafter, the electric charge on the photoreceptor 24 is eliminated by a static eliminator 31 and the next cycle of copying operation is commenced. Generally, this static eliminator 31 comprises a static eliminating lamp or the like for eliminating the electric charge with light projected therefrom, or alternatively has the same structure as that of the charger 25. Such a static eliminator device 31 is essential to an electrophotographic copying machine, since if the copying machine is designed without the static eliminator 31, the surface potential at the photoreceptor 24 will continuously increase due to continuous charging by means of the charger 25. This causes troubles such as a dielectric breakdown in the photoreceptor or the like because of overcharging.

While the personalization of electrophotographic copying machines is expedited recently, a need for small-sized and low-priced copying machines is increasing. Conventional copying machines having such a static eliminator 31 can, however, no longer meet the above need.

A charger having a gird provided therein, i.e., a scorotron charger has been generally used for the purpose of overcoming the above problems. In the use of the scorotron charger, when the potential is lower at the photoreceptor 24 than at the gird, a charge applied the photoreceptor 24 by the scorotron charger is preferentially applied to the photoreceptor 24, while the charge preferentially flows to the grid in the case the potential of the photoreceptor 24 becomes close to the potential of the grid. Hence, the potential of the photoreceptor 24 can be maintained at a specified level without using the static eliminator 31. Specifically, in the use of the scorotron charger, the grid prevents overcharge caused by continuously charging the surface of the photoreceptor 24, and allows the photoreceptor 24 to be uniformly charged without using the static eliminator. This contributes to the miniaturization of copying machines.

Although the overcharge can be prevented by the above scorotron charger, there still remains such a drawback that the quality of reproduced images is deteriorated due to a change in the surface potential of the photoreceptor 24 occuring after the initial rotation period (several rotations) of the photoreceptor 24.

Furthermore, high processing and assembling accuracies are required for the cleaning device and charger, and therefore there is a difficulty in miniaturizing copying machines.

A charger 25 having a charging wire 25*b* for releasing a corona charge and stretched within a metal frame 25*a*, has been generally used as the charger 25. This type of charger is conventionally formed as a single unit, and the frame 25*a* is formed for the charger's exclusive use. Hence, there has been a strong need for parts which can be used for multiple purposes in order to produce small-sized and low-priced copying machines.

SUMMARY OF THE INVENTION

An object of the present invention is to provide an image forming apparatus wherein a frame is used both as a cleaning device and charger, thereby saving the manufacturing cost of the parts and developing the miniaturization of the image forming apparatus.

Another object of the present invention is to provide an image forming apparatus having a long-lived photoreceptor the surface potential of which is not varied even if the photoreceptor is repeatedly used, thereby producing reproduced images having constant quality for a long period.

Still another object of the present invention is to provide an image forming apparatus wherein the charger and cleaning device are integrally formed, thereby improving the processing and assembling accuracies of the image forming apparatus.

Still another object of the present invention is to provide an image forming apparatus wherein a predetermined voltage is applied to the frame of the cleaning device, thereby performing stable corona-discharging.

In order to achieve the foregoing objects, an image forming apparatus according to the present invention comprising a charger, developing device, transferring device, and cleaning device which are positioned around a photoreceptor, is characterized in that the charger comprises a control unit for controlling the surface potential of the photoreceptor to be at a predetermined level in accordance with the number of rotations of the photoreceptor or the rotating time thereof, and the cleaning device and charger are integrally formed.

The charger may comprise a charging wire, charger case enclosing the charging wire, grid disposed between the charging wire and photoreceptor. Alternatively, the charger may comprise a conductive brush.

With the above arrangement, the grid voltage is changed by the control unit in accordance with the number of rotations of the photoreceptor, thereby maintaining the surface potental of the photoreceptor at a predetermined level. The surface potential of the photoreceptor can be also maintained at a predetermined level by changing the grid voltage according to the rotating time of the photoreceptor. This contributes to producing reproduced images having constant quality when the photoreceptor is repeatedly used as well as improvement of the durability of the photoreceptor.

Furthermore, since this arrangement dispenses with the static eliminator, and makes is possible to integrally form the charger and cleaning device, the efficiency in assembling a copying machine can be improved and the space in the apparatus is more efficiently utilized in order to miniaturize the copying machine.

Another alternative image forming apparatus according to the present invention comprising a charger, developing device, transferring device, and cleaning device which are positioned around the photoreceptor, is characterized in that a frame of the cleaning device is partially integral with a part of a frame of the charger, and a predetermined voltage is applied to the frame of the cleaning device.

The voltage applied to the frame of the cleaning device may be set to a ground potential.

The charger may comprise a frame and a charging wire stretched within the frame.

The charger may comprise a frame, charging wire stretched within the frame and grid disposed between the charger and the photoreceptor.

With the above arrangement, a predetermined voltage is applied to the frame of the cleaning device. This enables stable corona discharging toward the photoreceptor. The frames of the cleaning device and charger are partially integrally formed, reducing the manufacturing cost of the frame. Hence, this contributes to the reduction of the manufacturing cost of a copying machine as well as the miniaturization thereof.

The invention and its various advantages will become more apparent to those skilled in the art from the ensuing detailed description of preferred embodiments, reference being made to the accompanying drawings.

BRIEF DESCRIPTION OF THE DRAWINGS

FIG. 1 is a schematic sectional view showing the essential parts of an image forming apparatus.

FIG. 2 is a block diagram showing the structure of a control unit.

FIG. 3 is a view showing a change in the surface potential of a photoreceptor when the surface potential is not controlled by the control unit.

FIG. 4 is a view showing a change in a voltage to be applied to a grid disposed in a charger.

FIG. 5 is a view showing a change in the surface potential of the photoreceptor after being controlled.

DESCRIPTION OF THE EMBODIMENTS

Referring now to FIGS. 1 to 5 of the accompanying drawings, an embodiment of the present invention will be described in detail below.

Figure 1:
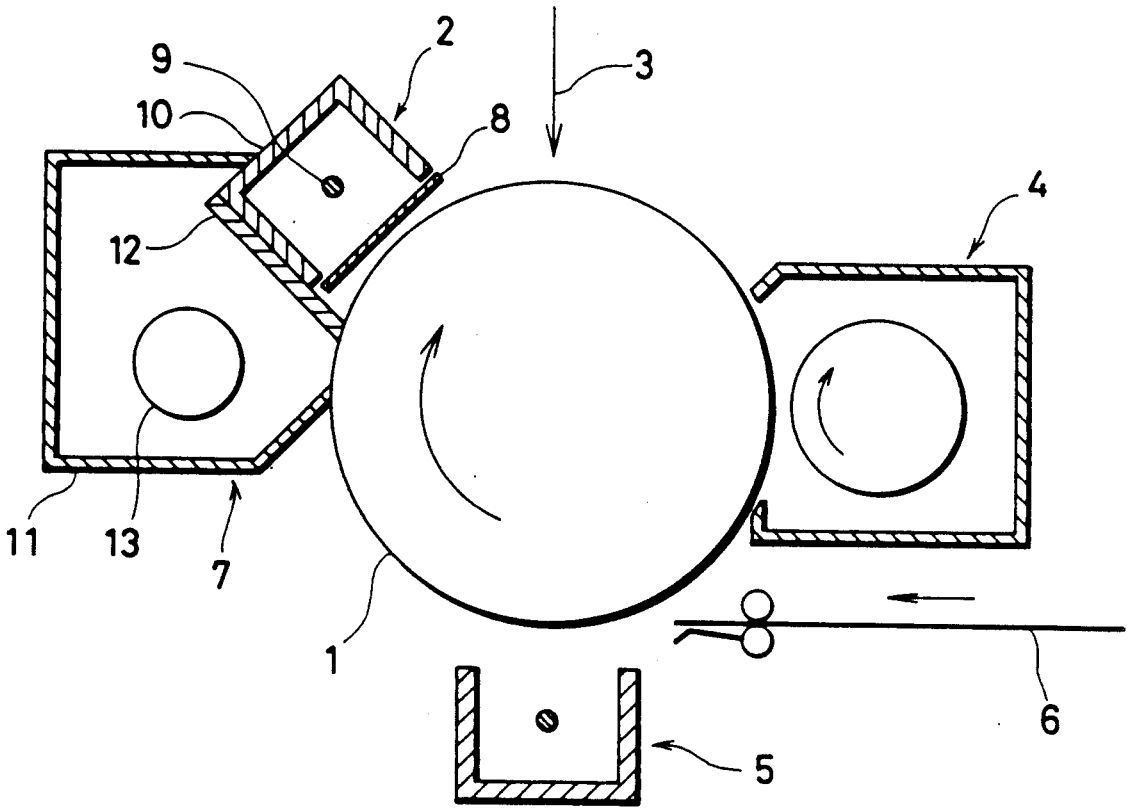
FIGS. 1 to 5 show an embodiment of the present invention.

As shown in FIG. 1, an image forming apparatus according to the present invention is provided with a charger 2, developing device 4, transferring device 5 and cleaning device 7 which are disposed around a photoreceptor 1. The charger 2 comprises a control unit 14 (shown in FIG. 2) for controlling the surface potential of the photoreceptor 1 at a predetermined level in accordance with the number of rotation or the rotating time of the photoreceptor to be 1. The charger 2 and the cleaning device 7 are integrally formed.

In this embodiment, the scorotron method is applied to the charger 2, in which a charging wire 9 (tungsten wire) connected to a high-voltage power supply (not shown), a charger case 10, (i.e. a frame enclosing the charging wire 9) and a grid 8 disposed between the charging wire 9 and photoreceptor 1 are provided.

The charger case 10 for supporting the charging wire 9 is made of an electrically conductive material, having a section in the form of ]. A voltage is applied to the above grid 8 which is in the form of a wire net, by means of its own power supply. The and the grid voltage thus applied has the same polarity as that of the corona voltage of the charger 2 and is normally several hundred volts.

Figure 2:
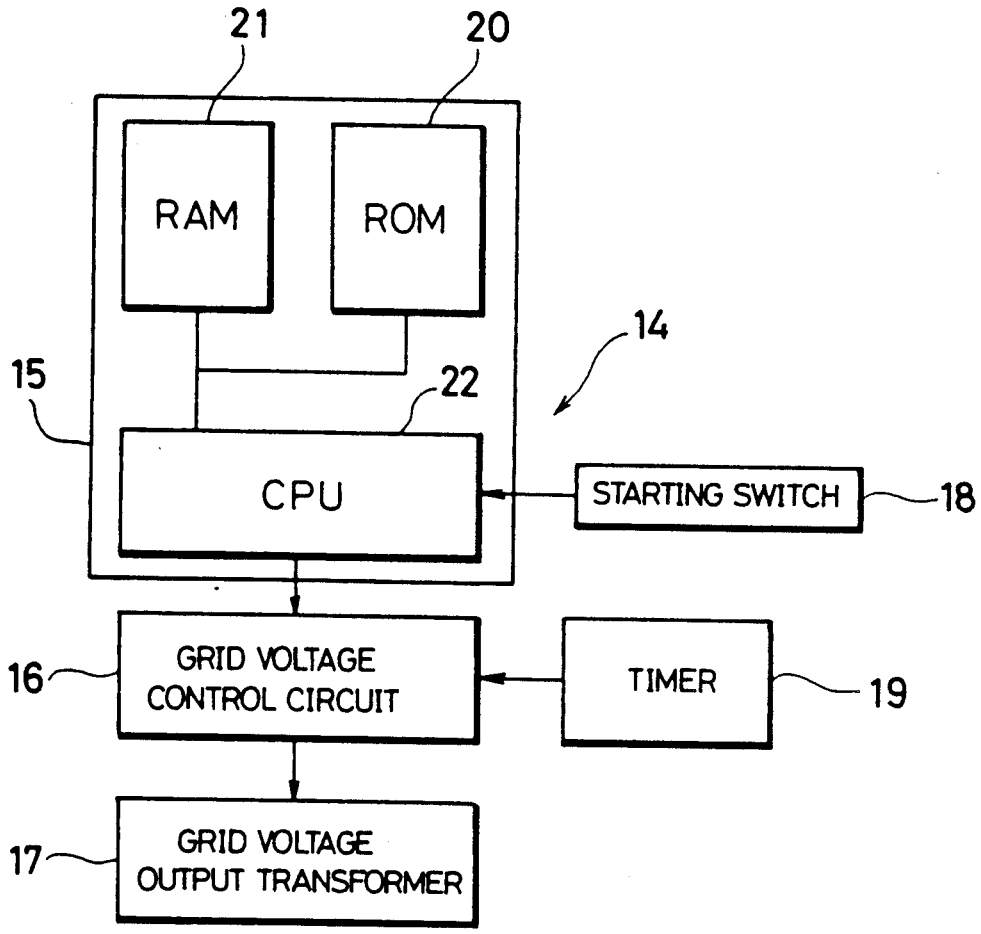

The control unit 14 comprises, as shown in FIG. 2, a control device 15 serving as a main control means, grid voltage control circuit 16 serving as a voltage control means, and grid voltage output transformer 17 serving as a voltage output means. The control device 15 is a standard type of microcomputer comprising a program ROM 20, data RAM 21 and CPU 22 and the like stored therein, and is driven in accordance with a clock signal from a reference clock signal generator (not shown). This control device 15 is connected to a starting switch 18 at the input side and to the grid voltage control circuit 16 for controlling a grid voltage at the output side. The grid voltage control circuit 16 is controlled by a timer 19 and is connected to the grid voltage output transformer 17 for applying a voltage to the grid 8 upon receipt of an output signal from the grid voltage control circuit 16.

The cleaning device 7 comprises a blade 12 disposed in contact with the surface of the photoreceptor 1, frame 11 for receiving residual toner scraped off by the blade 12 and screw roller 13 for conveying the residual toner to one end of the frame 11. The frame 11 is installed at the charger case 10, and the blade 12 is installed at an outer side face of the charger case 10, opposing to the cleaning device 7.

In the above arrangement, the photoreceptor 1 is rotated at the time of development, and an image pattern is projected on the surface of the photoreceptor 1 by a refleted light 3 from the surface of an original to which a light from an exposure device (not shown), e.g., a laser beam has been irradiated. The potential in the area to which the reflected light 3 is irradiated, is decreased, whereby an electorstatic latent image is formed. As the photoreceptor 1 rotates, toner adheres to the electrostatic latent image, thereby forming a visible image by the developing device 4. This toner image is transferred onto a copy sheet 6 by the transferring device 5. The photoreceptor 1 continues to rotate and residual toner thereon is scraped off by the cleaning device 7. The electrostatic latent image still remains on the surface of the photoreceptor 1 after the area where the electrostatic latent image has been formed passes in front of the cleaning device 7. Since the charger 2 charges the photoreceptor 1 all the time during the image formation, the above area is uniformly charged again by the function of the grid 8 in the charger 2, when the area passes in front of the charger 2 in the next cycle of copying operation. After the image formation is completed, the photoreceptor 1 is additionally rotated at least one time along the exposure device, thereby eliminating the charge.

Figure 3:
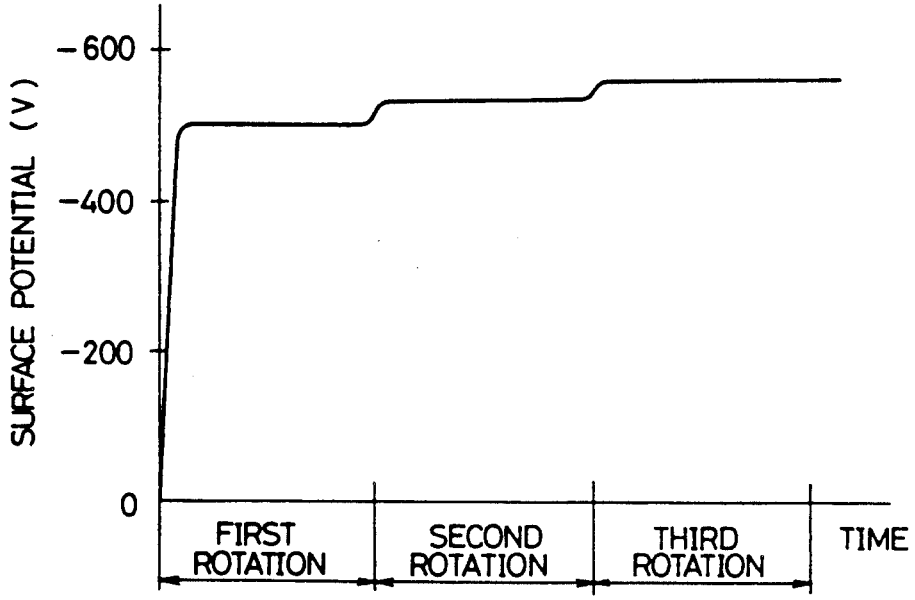

The overcharging of the photoreceptor 1 can be prevented by the potential controlling properties of the charger 2, but the surface potential of the photoreceptor 1 increases, as shown in FIG. 3, according to the number of rotations of the photoreceptor 1. To be more concrete, at the time of a second rotation, the surface potential of the photoreceptor 1 increases to more than that of a first rotation by approximately 40 V, and at the time of a third rotation, it again increases over the second rotation by approximately 20 V.

Figure 4:
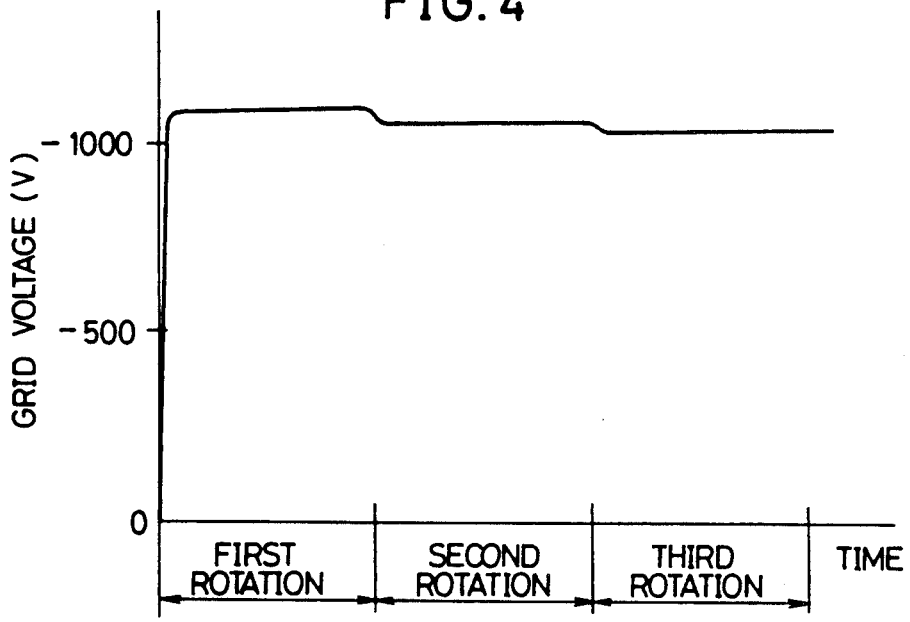
Figure 5:
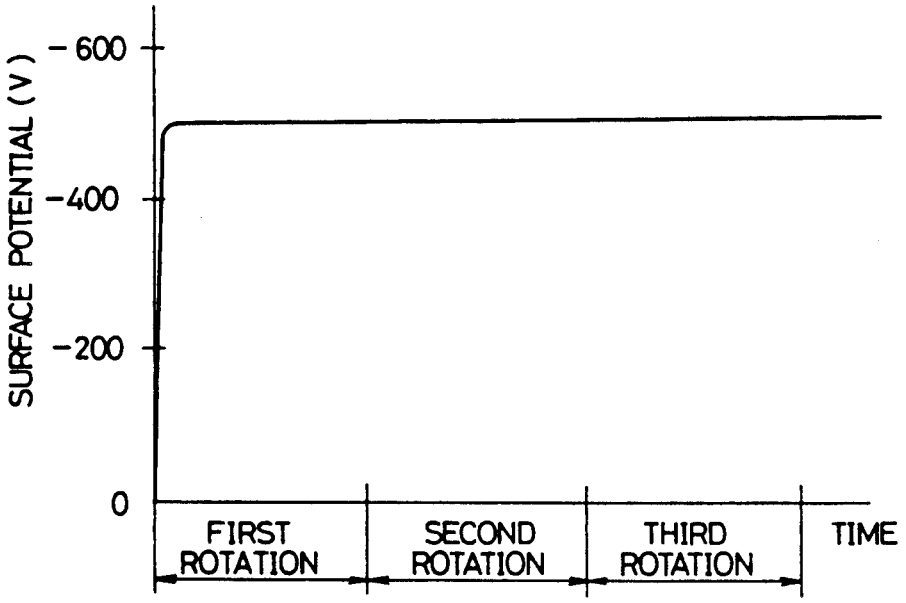

In order to maintain the surface potential of the photoreceptor 1 at a predetermined level, a voltage to be applied to the grid 8 at the time of the second rotation of the photoreceptor 1 is controlled to be about 40 V lower than that applied at the time of the first rotation, by means of the control unit 14, as shown in FIG. 4. Likewise, a voltage about 20 V lower than that at the time of the second rotation is applied to the grid 8 when the photoreceptor 1 is rotated at the third time. As described above, the surface potential of the photoreceptor 1 can be maintained at a predetermined level all the time as shown in FIG. 5, irrespective of the number of rotations of the photoreceptor 1, by decreasing the grid voltage, as shown in FIG. 4, in accordance with the number of rotations of the photoreceptor 1.

Figure 6:
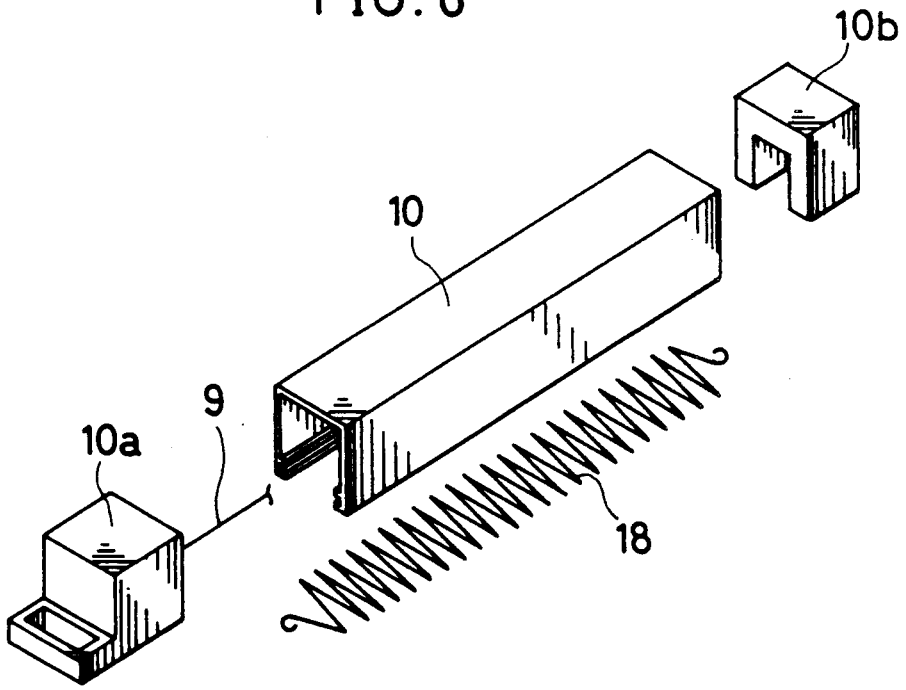
FIG. 6 is a perspective view of a charger according to another embodiment of the present invention.

The grid 8 is not limited to the wire-net shaped grid mentioned in the above embodiment, but may be zigzag in shape as shown in FIG. 6. The reference numerals 10*a* and 10*b* of FIG. 6 respectively represent a holder for holding a charging wire 9.

In the foregoing embodiment, the grid voltage is changed for every rotation of the photoreceptor 1. Also, it is possible to correct the surface potential of the photoreceptor 1 so as to be a predetermined level by changing the grid voltage in accordance with the rotating time in analog formed.

Figure 7:
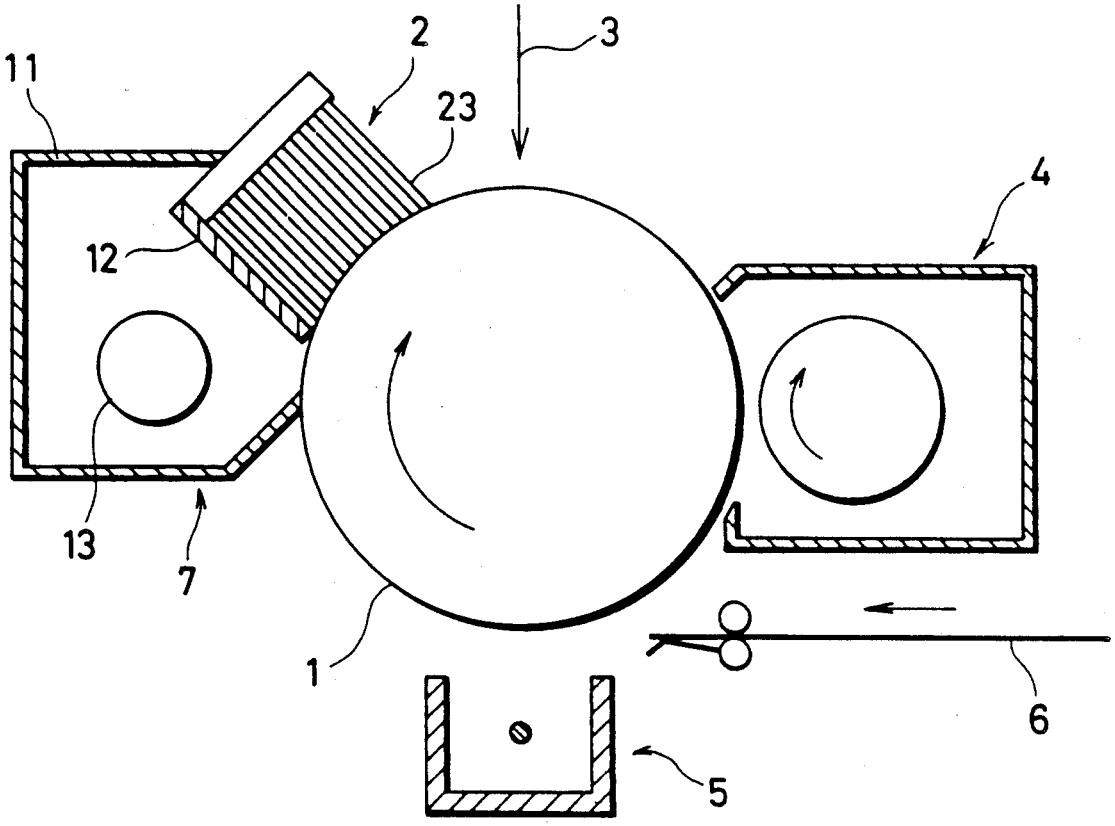
FIG. 7 is a schematic sectional view showing the integral parts of an image forming apparatus according to still another embodiment of the present invention.

In lieu of the scorotron charger having a grid, a conductive brush 23 as shown in FIG. 7 may be used as the charger 2.

Figure 8:
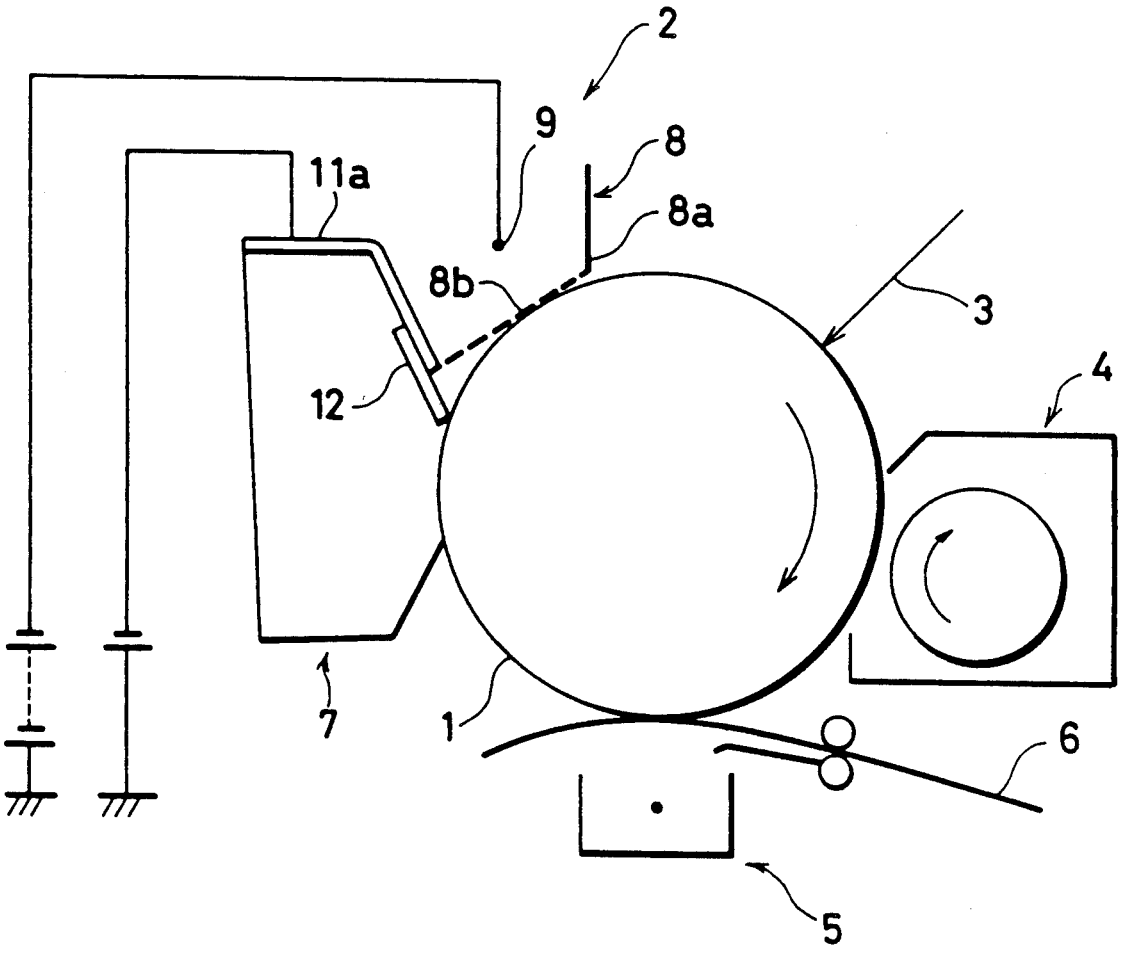
FIG. 8 is a schematic sectional view showing the integral parts of an image forming apparatus according to still another embodiment of the present invention.
Figure 9:
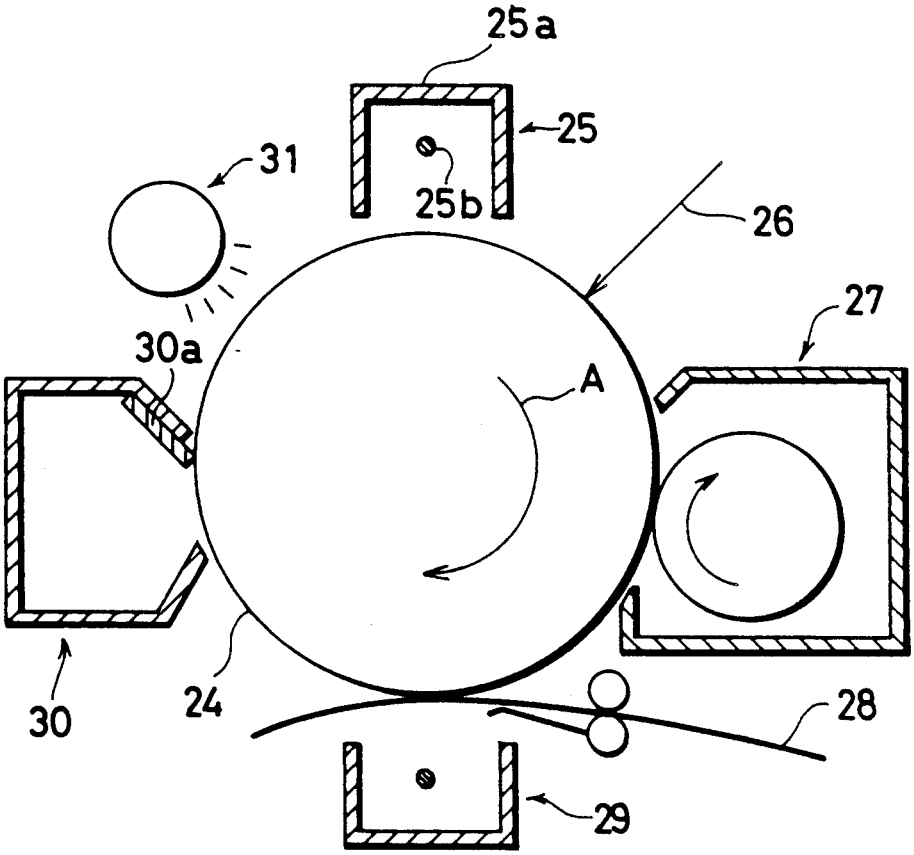
FIG. 9 is a schematic sectional view showing the integral parts of an image forming apparatus of a conventional copying machine.

Another embodiment of the image forming apparatus of the present invention will be described with reference to FIG. 8. The description of the parts that are substantially equivalent to those mentioned in the foregoing embodiment is omitted.

The frame of the cleaning device 7 is in the form of a box having an opening opposing the photoreceptor 1. At least an upper frame 11*a* is made of metal, and a blade 12 made of silicon rubber, elastic resin or the like is attached to the upper frame 11*a*. This upper frame 11*a* is also used as the frame of the charger 2 and the grid 8 is attached thereto. The grid 8 is bent with a folding line parallel with the longitudinal direction thereof so as to form a part 8*a* and another part 8*b*. The part 8*b* opposing the photoreceptor 1 takes the form of a wire net and the part 8*a* elongating from the end of the part 8*b* as shown in FIG. 8 takes the form of a plate. The grid 8 is provided with the charging wire 9 stretching from one end to the other end thereof (not shown). The same voltage is usually applied to the upper frame 11*a* and grid 8. This voltage having the same polarity as that of the voltage to be applied to the charging wire 9 is set to around several hundred volts.

In the above arrangement, a voltage is applied to the upper frame 11*a* in the course of development, thereby stabilizing the discharging properties of the charger 2 and efficiently charging the surface of the photoreceptor 1. Normally, the voltage to be applied to the upper frame 11*a* is substantially as same as that to be applied to the grid 8, but it may be set to a ground potential. This depends on the distribution ratio of the voltage applied to the upper frame 11*a* and grid 8. In particular, when the size of the photoreceptor 1 is relatively large, the discharging properties of the charger 2 decrease and the voltage to be applied to the upper frame 11*a* is, therefore, set to a ground potential. As the miniaturization of copying machines is expedited in recent years, the photoreceptor is getting smaller, so that it is preferable to apply a predetermined voltage to the upper frame 11*a* in view of stable discharging.

A charger of the scorotron type is employed in this embodiment, but it is also possible to employ a charger in which the corona charging method is adopted without using a grid. In this case, a part of the frame of the cleaning device is used as a part of the frame of the charger. Since the charger and the cleaning device are integrally formed in the above arrangement, the static eliminator for eliminating the charge on the surface of the photoreceptor may be set in front of the cleaning device. The cleaning device and the shape of the frame of the charger are not limited to the foregoing embodiment, and alternatives are possible on condition that the frame of the cleaning device is used as the frame of the charger and a voltage is applied to this frame.

As described above, an image forming apparatus according to the present invention comprising a charger, developing device, transferring device and cleaning device which are disposed around a photoreceptor is characterized in that the charger comprises a control unit for controlling the surface potential of the photoreceptor in accordance with the number of rotations or the rotating time of the photoreceptor, and the cleaning device and charger are integrally formed.

This arrangement does not only improve the reliability in the production of reproduced images of constant quality in the case the photoreceptor is repeatedly used, but also contributes to the durability of the photoreceptor. Moreover, one of the processing/assembling processes which require accuracy can be eliminated by integrally forming the charger and cleaning device, since the position of either of the above devices is automatically determined, only by accurately setting the other with respect to the photoreceptor. This also reduces an error in processing and assembling processes, thereby improving the reliability of the copying machine, reducing the manufacturing cost, and improving the miniaturization of copying machines. While the need for the miniaturization of copying machines, optical printers and the like and for a reduction in the manufacturing cost thereof increases, there is a growing tendency to shorten the diameter of the photoreceptor drum. However, the processing speed of the copying machine cannot be delayed in compliance with the shortening of the diameter of the photoreceptor drum, and therefore, a need for rotating the photoreceptor drum at a high speed arises. A space for installing each device is limited in view of the charging process, so that there is a likelihood that the surface of the photoreceptor will not be sufficiently charged if the charger is miniaturized in compliance with the photoreceptor and the photoreceptor rotates at a high speed. With the image forming apparatus of the present invention, the aforesaid problems can be overcome. More specifically, the space conventionally used for the static eliminator as well as the space used when the charger and cleaning device are separately formed becomes unnecessary, and therefore the width of the charger can be increased by utilizing the above spaces in order to cope with the high-speed rotation of the photoreceptor. In a copying machine designed such that the parts composing the cleaning device are replaced at the time of the collection of residual toner, the parts composing the charger can be also replaced when collecting the residual toner. This saves users' time and labour.

Another alternative image forming apparatus according to the present invention comprising a charger, developing device, transferring device and cleaning device which are disposed around a photoreceptor is characterized in that a part of a frame of the cleaning device is also used as a part of a frame of the charger, and a predetermined voltage is applied to the frame of the cleaning device.

Such an arrangement that a part of the frame is used both as the cleaning device and charger contributes to the saving of space and reduction in cost especially for a small-sized copying machine which is recently prevailing. Furthermore, in a small-sized copying machine, discharging by the charger can be stabilized by disposing a frame to which a voltage is applied so as to enclose the charging wire.

The invention being thus described, it may be obvious that the same may be varied in many ways. Such variations are not to be regarded as a departure from the scope of the invention.

There are described above novel features which the skilled man will appreciate give rise to advantages. These are each independent aspects of the invention to be covered by the present application, irrespective of whether or not they are included within the scope of the following claims.

What is claimed is:

1. An image forming apparatus comprising:

a photoreceptor, charging means for charging said photoreceptor, developing means for developing an electrostatic latent image on said photoreceptor to form a visible image, transferring means for transferring said visible image onto a copy material, and cleaning means for removing residual toner from the surface of said photoreceptor, said charging means, said developing means, said transferring means and cleaning means being positioned around said photoreceptor, said charging means including a grid, and a control means for:

(a) applying a voltage to said grid, (b) controlling said voltage according either to the number of rotations of said photoreceptor or the rotation time of said photoreceptor, and (c) maintaining the surface potential of said photoreceptor at a constant level.

2. An image forming apparatus according to claim 1 wherein the grid is designed so as not to completely interrupt the flow of electrical charge from said charging means to said photoreceptor.

3. An image forming apparatus according to claim 2 wherein the grid is in the form of a wire net.

4. An image forming apparatus according to claim 2 wherein the grid is zig-zag in shape.

5. An image forming apparatus according to claim 1 wherein parts of said charging means and said cleaning device are replaceable.

6. An image forming apparatus according claim 1 wherein the charging means has a charging wire made of tungsten.

7. The image forming apparatus of claim 1 wherein said control means includes a starting switch for allowing said image forming apparatus to start an image forming operation, timing means for starting a timing operation in response to an operation of said starting switch and for outputting an output signal indicating an elapse of time corresponding either to the number of rotations of said photoreceptor or to the rotation time of said photoreceptor, grid voltage controlling means for receiving said output signal from said timing means and for selecting a voltage to be applied to said grid according to said output signal so that the surface potential of said photoreceptor is maintained at said constant level, and grid voltage output means for applying said voltage to said grid, wherein the surface potential of said photoreceptor is maintained at said constant level and the quality of produced image is not deteriorated even after said photoreceptor is repeatedly used.

8. The image forming apparatus of claim 1 wherein said charging means and said cleaning means are integrally formed.

9. The image forming apparatus of claim 1 wherein said cleaning means has a frame, a portion of said frame being formed as a part of said charging means, said frame being provided with toner scraping means, said toner scraping means having an end section which is in contact with said photoreceptor.

10. An image forming apparatus according to claim 9 wherein the frame of said cleaning device is made of metal.

11. An image forming apparatus according to claim 9 wherein the voltage to be applied to the frame of said cleaning device is set to a ground potential.

12. The image apparatus of claim 1 further comprising charge eliminating means for eliminating charge from the surface of said photoreceptor, said charge eliminating means being disposed between said cleaning means and said transferring means.

13. The image forming apparatus of claim 1 wherein said charging means further includes a charging wire and a charger case enclosing said charging wire, said grid being positioned between said charging wire and said photoreceptor.

* * * * *